US006539293B2

(12) United States Patent
Bächtiger et al.

(10) Patent No.: US 6,539,293 B2
(45) Date of Patent: Mar. 25, 2003

(54) METHOD AND DEVICE FOR MONITORING BOGIES OF MULTI-AXLE VEHICLES

(75) Inventors: Rolf Bächtiger, Oberwil-Lieli (CH); Max Loder, Bonstetten (CH); Reto Schreppers, Wettswil (CH)

(73) Assignee: Siemens Schweiz AG, Zurich (CH)

( * ) Notice: Subject to any disclaimer, the term of this patent is extended or adjusted under 35 U.S.C. 154(b) by 0 days.

(21) Appl. No.: 09/968,306

(22) Filed: Oct. 1, 2001

(65) Prior Publication Data

US 2002/0056398 A1 May 16, 2002

Related U.S. Application Data

(63) Continuation of application No. PCT/CH00/00033, filed on Jan. 26, 2000.

(30) Foreign Application Priority Data

Apr. 1, 1999 (CH) ..... 627/99

(51) Int. Cl.[7] ..... G05D 1/00

(52) U.S. Cl. ..... 701/20; 73/579; 73/659; 73/660

(58) Field of Search ..... 701/19, 20; 73/579, 73/654, 587, 659, 660, 583, 146; 246/169 R; 105/157.1

(56) References Cited

U.S. PATENT DOCUMENTS

| | | | | |
|---|---|---|---|---|
| 5,419,197 A | | 5/1995 | Ogi et al. | 73/659 |
| 5,433,111 A | | 7/1995 | Hershey et al. | 73/593 |
| 5,621,646 A | * | 4/1997 | Enge et al. | 342/356 |
| 6,317,603 B1 | * | 11/2001 | Allison | 342/357.06 |
| 6,324,474 B1 | * | 11/2001 | Beisner et al. | 342/357.01 |
| 2002/0024461 A1 | * | 2/2002 | Moeglein et al. | 342/357.1 |

FOREIGN PATENT DOCUMENTS

| | | |
|---|---|---|
| DE | 195 02 670 A1 | 7/1996 |
| EP | 0 178 468 A2 | 4/1986 |
| JP | 10 339 629 A | 12/1998 |
| WO | WO 82/00805 | 3/1982 |
| WO | WO 95/31053 | 11/1995 |

OTHER PUBLICATIONS

Angel Hermida San Martin, Faustino et al.: "Intelligent hot–box detection ensures safety on the Madrid—Seville high–speed line", in *Signal+Draht* [signal+wire], Tetzlaff Verlag Hamburg, Jan./Feb. 1999, pp. 30–33.

* cited by examiner

*Primary Examiner*—Thomas G. Black
*Assistant Examiner*—Ronnie Mancho
(74) *Attorney, Agent, or Firm*—Laurence A. Greenberg; Werner H. Stemer; Ralph E. Locher

(57) ABSTRACT

The behavior of the bogie of a muliple-axle vehicle is monitored. Accelerations of at least two axles of the bogie are measured with acceleration sensors allocated to the axles. The sensor signals are subjected to a Fourier transformation in FFT units. The frequency profiles resulting from the Fourier transform are compared with profiles that are stored in memory. Differences that are detected are compared with threshold values and messages are correspondingly sent to the system that controls the vehicle. The monitoring system allows mechanical operating errors of the bogie to be detected independently of effects caused by the running surface upon which the vehicle travels.

20 Claims, 4 Drawing Sheets

METHOD AND DEVICE FOR MONITORING BOGIES OF MULTI-AXLE VEHICLES

CROSS-REFERENCE TO RELATED APPLICATION

This application is a continuation of copending International Application No. PCT/CH00/00033, filed Jan. 26, 2000, which designated the United States.

BACKGROUND OF THE INVENTION

FIELD OF THE INVENTION

The invention relates to a method and a device for monitoring the bogies of multiple-axle vehicles. The method is applicable to vehicles which are guided on a roadway or on rails. The system includes acceleration sensors for converting vibrations of a monitored object into signals that are subsequently evaluated by a signal processing unit.

In rail traffic, defective elements of the bogies of train cars represent a hazard. Defects can develop owing to material wear during driving or insufficient maintenance. Because of the increased speeds on many stretches, the risk of accidents caused by defective axle bearings and brakes is growing.

In order to prevent accidents, it is desirable to detect abnormal operating conditions early, in order to be able to initiate corresponding safety measures (e.g. a reduction of driving speed) immediately.

The publication Signal+Draht [signal and wire], Tetzlaff Verlag Hamburg, January/February 1999, pages 30–33, describes a system wherein infrared sensors a placed along a track for sensing so-called hot boxes. When taking the measurement, it must be taken into consideration that the ambient temperature and sunshine can vary over a wide range, and that the monitored parts are usually covered with a layer of dirt. Furthermore, the axle bearings often have different operating temperatures, to which the measuring device must be adapted. In addition, the temperature measurement can only detect defects which cause heating of the monitored parts of the bogie.

It is therefore expedient to utilize a monitoring device which detects impermissible deviations not of thermal operating behavior, but rather of mechanical operating behavior, to which the measuring device expediently adapts.

U.S. Pat. No. 5,419,197 describes a device for detecting impermissible deviations of the mechanical operating behavior of a monitored object. That device includes an acceleration sensor which is mounted at the monitored object and which converts the vibrations of the subject into acceleration signals, which are processed in a signal processor and a neural network in order to detect impermissibly deviating operating behavior.

Using that type of monitoring device, it would also be possible to detect impermissible deviations of the mechanical operating behavior of a bogie on which an acceleration sensor is mounted. Since a bogie is not led on an ideal roadway, i.e. ideal rails, the mechanical operating behavior of the bogie is influenced not only by changes occurring within the bogie but also by feedback from the road or track. The danger therefore exists that feedback of the roadway or rails will cause misinterpretation of the mechanical operating behavior of the bogie, potentially triggering false error messages.

SUMMARY OF THE INVENTION

It is accordingly an object of the invention to provide a method and device for monitoring the bogies of multi-axle vehicles, which overcomes the above-mentioned disadvantages of the heretofore-known devices and methods of this general type and which allows deviations of changes in the mechanical operating behavior of the bogies to be measured independently of external influences.

With the foregoing and other objects in view there is provided, in accordance with the invention, a method of monitoring a bogie of a multi-axle vehicle guided on a running surface, such as a roadway or rails. The method comprises the following steps:

- detecting respective accelerations of at least two axles of the bogie with acceleration sensors;
- subjecting sensor signals received from the acceleration sensors to a Fourier transformation in FFT modules provided in an adaptation stage and generating frequency profiles with the FFT modules;
- selecting one or more comparison operations from the following group:
  - comparing the frequency profiles, in a first check module, to one another, to originally measured frequency profiles, and/or to a correspondingly selected standard profile;
  - comparing the frequency profiles, in a second check module, to respective average value profiles formed in storage stages; and
  - comparing the average value profiles formed in storage stages directly to each other, to originally measured frequency profiles, and/or to a correspondingly selected standard profile; and
- comparing determined deviations to threshold values, and accordingly delivering message signals to systems serving to control the vehicle.

In an alternative method according to the invention, the following steps are required:

- detecting respective accelerations of at least two axles of the bogie with acceleration sensors;
- shifting sensor signals received from the acceleration sensors relative to one another with a controllable timing element, to compensate for a time difference between instants at which the wheels of the bogie respectively pass a given point on the running surface;
- subtracting the shifted signal curves from one another in a difference stage to form a resulting signal curve $s_{res}=s_{11a}-{}^{*}s_{11b}$ representing a condition of the bogie; and
- comparing the resulting signal curve to at least one threshold value or threshold value profile in a signal processing unit.

In accordance with an added feature of the invention, the time difference between the instants is calculated by correlating the sensor signals ($s_{11a}-s_{11b}$ and $s_{11a}-{}^{*}s_{11b}$), or from a velocity of the vehicle and a spacing between the axles carrying the respective wheels.

In accordance with another feature of the invention, there is provided a first threshold value or threshold value profile, and it is determined therewith, by comparison with the signal curve, whether vibrations are being caused by the running surface or by an anomaly of the bogie; and/or providing a second threshold value or threshold value profile, and determining therewith whether the bogie contains a defect that should be signaled.

In accordance with a further feature of the invention, the deviations determined in the first check module and/or the second check module are registered as defects of the bogie or the running surface in dependence on a result of an evaluation of the signal curve $s_{res}=s_{11a}-{}^{*}s_{11b}$, where $s_{11a}$ is a sensor signal and ${}^{*}s_{11b}$ is the delayed sensor signal.

In accordance with again an added feature of the invention, one of the threshold values and the threshold value profiles is modified, selected as a function of frequency, in dependence on one of a velocity and an acceleration of the vehicle.

In accordance with again an additional feature of the invention, the disturbances detected in dependence on the deviations are linked to time and/or location information.

In accordance with a further feature of the invention, there is determined, in the signal processing unit, a period duration of periodically occurring disturbances, and a velocity of the vehicle is calculated as a function of a diameter of the wheels.

With the above and other objects in view there is also provided, in accordance with the invention, a device for monitoring a bogie of a multi-axle vehicle guided on a running surface such as rails or a road, comprising:

a plurality of acceleration sensors respectively disposed for sensing vibrations of at least two axles of the bogie and configured to convert vibrations of the axles into sensor signals;

a signal processing unit connected to the sensors for receiving the sensor signals for further evaluation; an adaptation stage having at least one FFT module connected to receive the sensor signals from the acceleration sensors and for outputting frequency profiles;

at least one comparison unit selected from the group of units consisting of:

a first check module configured for one of comparing the frequency profiles to one another, comparing the frequency profiles to originally measured frequency profiles, and comparing the frequency profiles to a correspondingly selected standard profile;

storage stages, and a second check module configured to compare the frequency profiles to respective average value profiles formed in the storage stages; and a comparator for comparing the average value profiles formed in the storage stages directly to each other, to originally measured frequency profiles, or to a correspondingly selected standard profile; and a device for comparing the determined deviations with threshold values, and for delivering messages accordingly to systems serving to control the vehicle.

Alternatively, the device for monitoring a bogie of a multi-axle vehicle guided on a running surface comprises:

a plurality of acceleration sensors respectively disposed for sensing vibrations of at least two axles of the bogie and configured to convert vibrations of the axles into sensor signals;

a controllable timing element connected to receive the sensor signals for shifting the sensor signals relative to one another to compensate for a time difference between instants at which the wheels of the bogie respectively pass a given point on the running surface;

a difference stage for subtracting the shifted signal curves from one another to form a resulting signal curve $s_{res}=s_{11a}-{}^{*}s_{11b}$ representing a condition of the bogie; and a signal processing unit for comparing the resulting signal curve $s_{res}=s_{11a}-{}^{*}s_{11b}$ to at least one threshold value or threshold value profile.

The inventive method makes it possible to detect changes of the mechanical operating behavior of bogies without being influenced by effects caused by the road or rails. In an expedient development of the invention, it is possible to measure the external influences of the roadway or rails and thereby determine their condition. The condition of the route can thus be checked with each rail trip. Furthermore, in advantageous developments of the inventive solution, it is also possible to measure the speed and respective position of the vehicle. Thus, the location, time and speed can also be stamped on the individual measurement results, or on the error or alarm messages. In expedient embodiments, the measured speed is utilized as a parameter for evaluating the mechanical operating behavior of the bogie, on one hand, and for precisely determining external influences, on the other hand. In a separate expedient development, external influences caused by the controlling of the vehicle are also taken into consideration.

Other features which are considered as characteristic for the invention are set forth in the appended claims.

Although the invention is illustrated and described herein as embodied in a method and a device for monitoring the bogies of multi-axle vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
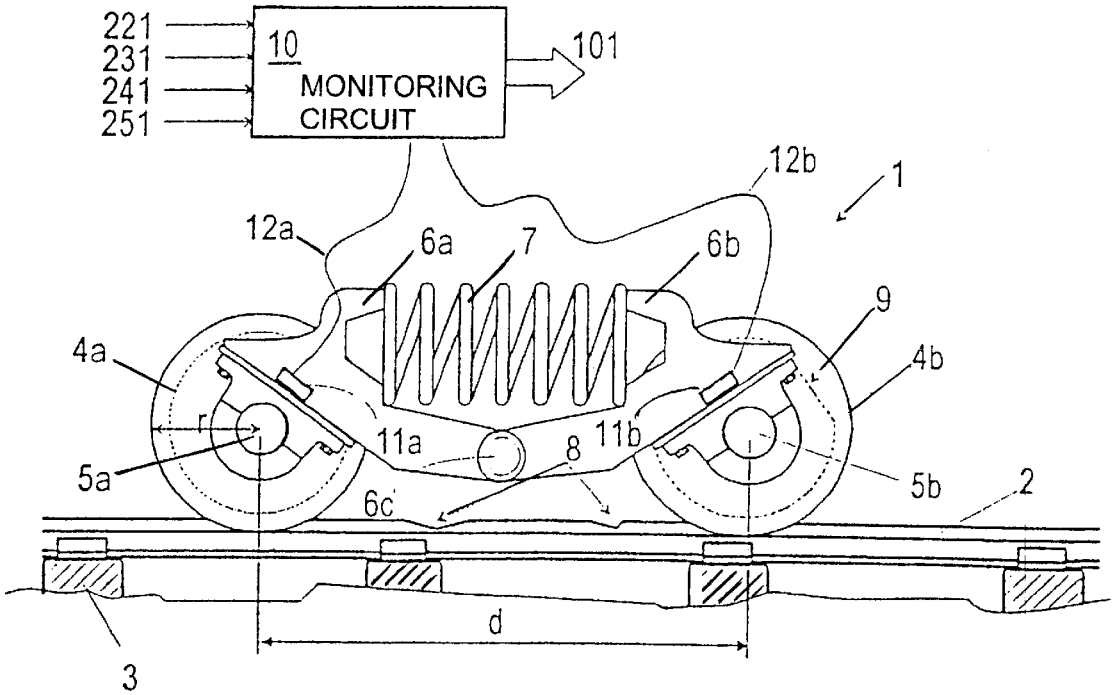
FIG. 1 is a diagrammatic view of a bogie 1 with monitoring circuit according to the invention.

Referring now to the figures of the drawing in detail and first, particularly, to FIG. 1 thereof, there is shown a bogie 1 for rail cars as described in U.S. Pat. No. 6,098,551 (international PCT publication WO 97/23375). The bogie 1 is guided on rails 2 which are mounted on cross ties 3. The bogie 1 consists of two frame parts 6*a*, 6*b*, each including a bearing for accepting the wheel axles 5*a*, 5*b* that are connected to the wheels 4*a*, 4*b*, which are connected to each other by a joint 6*c* and press against a spring unit 7 from either side when a load, the weight of the bogie frame 6, and the possibly installed car cabin press the joint 6*c* downward. Likewise, accelerations of the wheel axles 5*a*, 5*b* which are caused by defective areas 8, 9 of the wheels 4*a*, 4*b*, or the road or tracks 2, are picked up by the spring unit 7.

In FIG. 1, the wheel 4*b* contains a smoothed or flattened portion 9, and the rails 2 have two notches 8, which influence the vibrating behavior of the bogie 1. Deviations of the mechanical operating behavior of the bogie can thus be caused by defects of the bogie 1 or the rails 2. According to the invention, it should be possible to determine whether the bogie 1 comprises a defect, regardless of any defects of the rails 2.

To this end, each wheel bearing is provided with an acceleration sensor 11*a,* 11*b* for measuring accelerations of the axles 5*a*, 5*b*. The sensors 11*a,* 11*b* are connected to a monitoring circuit 10 by way of lines 12*a,* 12*b*.

Figure 2:
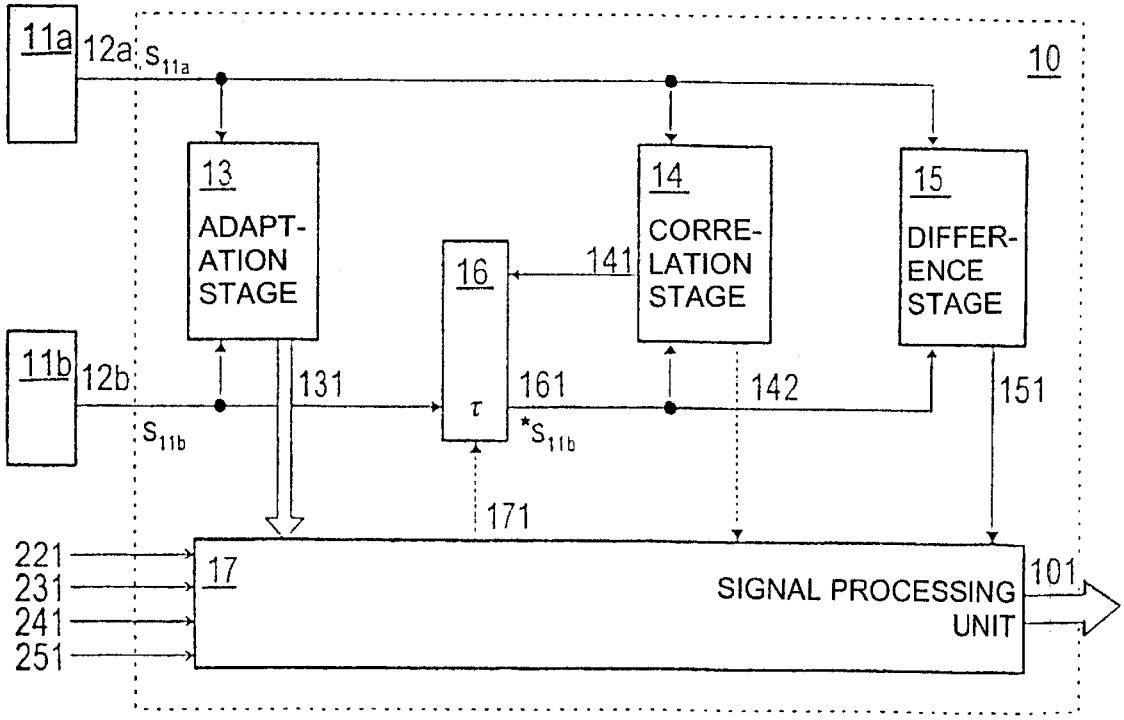
FIG. 2 is a block diagram of the internal construction of the monitoring circuit, including an adaptation stage, a correlation stage, and a difference stage.

FIG. 2 represents a possible internal structure of the monitoring circuit 10, wherein various evaluations of the signals $s_{11a}$, $s_{11b}$ that are supplied by the acceleration sensors 11*a*, 11*b* are possible. The sensor signals slia, $s_{11b}$ can be fed to an adaptation stage 13, wherein a continuous adapting to the mechanical operating behavior of the bogie 1 takes place.

Figure 5:
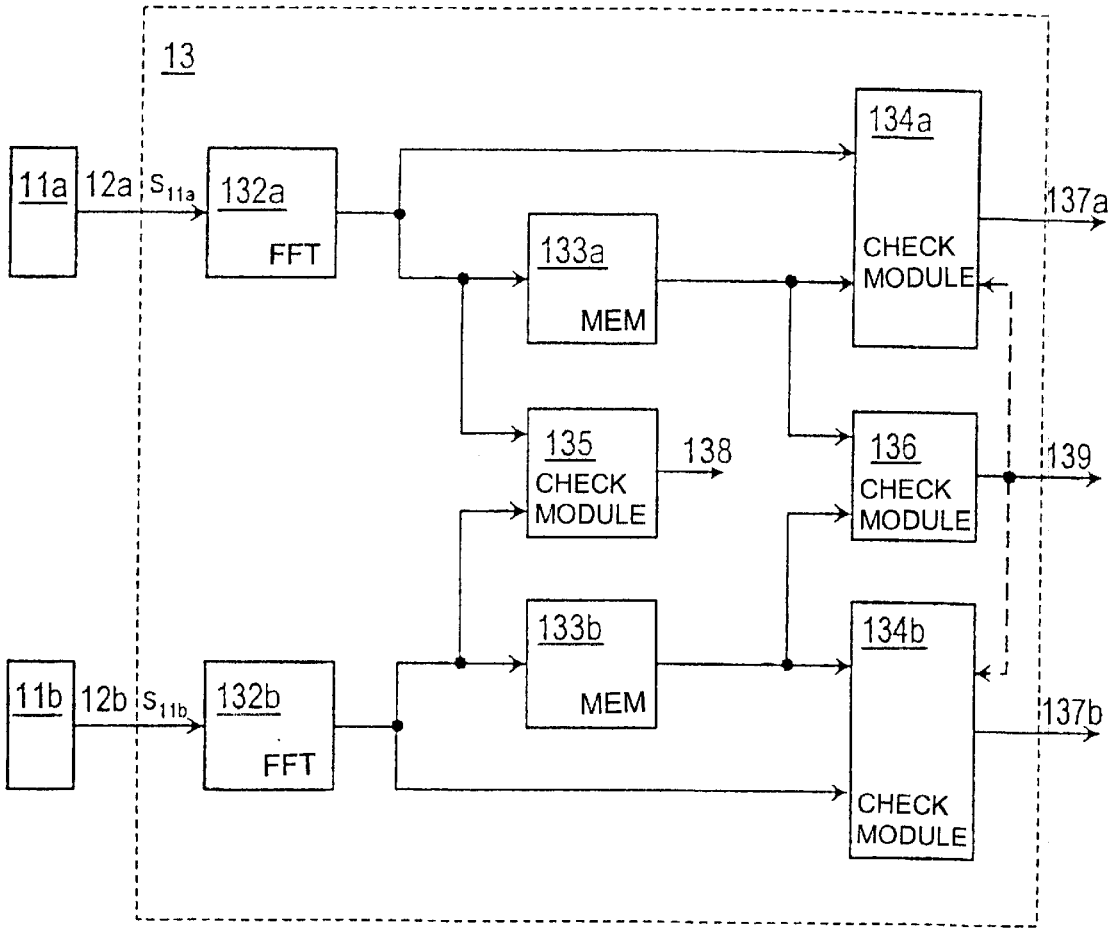
FIG. 5 is a block diagram of an advantageous development of the adaptation stage.

FIG. 5 represents a development of the adaptation stage 13 with which various evaluations of the sensor signals $s_{11a}$, $s_{11b}$ are possible. A simpler construction of the adaptation stage 13 is provided to the extent that it is possible to avoid individual evaluations of the sensor signals $s_{11a}$, $s_{11b}$.

In the adaptation stage 13, the sensor signals $s_{11a}$, $s_{11b}$ are fed to respective FFT modules 132*a* and 132*b* (FFT—fast Fourier transform), which are provided for the purpose of performing Fourier transformations of the supplied signals $s_{11a}$, $s_{11b}$, transforming the signals $s_{11a}$, $s_{11b}$ from the time domain into the frequency domain.

The frequency profiles which result from the Fourier transformation are fed to a first check module 135, wherein their deviations relative to each other, the originally measured frequency profiles, and/or a correspondingly selected standard profile are determined.

Deviations can be determined in the check module 135 with practically no delay.

Alternatively or additionally, the frequency profiles resulting from the Fourier transformation are fed—via storage stages 133*a* and 133*b,* wherein flattening average value profiles are formed—to a second check module 136, wherein the deviations of the formed average value profiles relative to one another, the originally measured average value profiles, and/or a correspondingly selected standard profile are determined. The weighting of new values is relatively low compared to the measured values of earlier measurement periods in the storage stages 133*a* and 133*b,* wherein average values were formed, so that short-term disturbances are practically without effect.

Deviations which emerge over a longer time can be precisely detected in the check module 136, wherein average value profiles that are formed over a longer time can be compared to one another. On the basis of the precise analyses, corresponding corrective measures can be automatically requested. If the two average value profiles change similarly, it can be determined that the change is not caused by a defect, but rather by aging of the wheels and bearings. If sharper deviations occur between the two profiles, a defect of the wheel set which deviates more sharply from the original profile can be ascertained.

Alternatively or additionally, the average value profiles which are read from the storage stages 133*a* and 133*b* can be fed to third and fourth check modules 134*a* and 134*b*, wherein they are compared to an instantaneous frequency profile. In the check modules 134*a*, 134*b*, the corresponding deviations can be determined almost without delay. To the extent that there is no variation occurring at the bogie 1, deviations which are determined by the check modules 134*a* and 134*b* are attributable to defects of the road or rails 2.

The evaluation of the deviations which are determined in the check modules 134*a*, 134*b*, 135 and/or 136 is performed in the check modules 134*a*, 134*b*, 135 and/or 136 themselves, or expediently in a signal processing unit 17, to which the data from the adaptation stage 13 can be fed over a data channel 131. The deviations are compared with allowable limit values in the signal processing unit 17, and if they are exceeded (or undershot), error messages are output to the control system of the vehicle or to the control center on the ground.

The signal processing unit 17, which evaluates the supplied signals, thus delivers precise information about the condition of the bogie 1 and the rails 2. Messages regarding the condition of the bogie 1 and the rails 2 are expediently associated with location information and possibly with time information as well, so that it is possible to deliver a damage message to personnel responsible for rail maintenance indicating the position of the damaged piece of track. The condition of the track material is thus checked each time it is crossed by the train, thereby obviating the need for inspection walks by maintenance personnel. The evaluation of the signal expediently occurs in consideration of various parameters, such as the speed of the vehicle (see also below).

Of course, the check modules 134*a*, 134*b* detect larger deviations between the average value profiles and the instantaneous frequency profiles if an axle or wheel suddenly breaks. This kind of defect must be detected immediately and be recognizable as a defect of the bogie 1 and not of the rails 2. An indicator of this is gained by comparing the signals $s_{12a}$, $s_{12b}$ which are delivered by the sensors 11*a* and 11*b,* which signals are shifted relative to one another far enough to compensate for a difference Td of the times t1, t2 at which the wheels 4*a*, 4*b* of the bogie 1 pass a point of the rails 2 or the road. As long as the difference of the two shifted signals $s_{12a}$, $s_{12b}$, (potentially upon correction by the deviation of the two average value profiles, which is determined by the check module 136), are identical, there are no defects present in the bogie 1. The deviations, which are detected by the check modules 134*a*, 134*b*, between the average value profiles and the instantaneous frequency profiles are therefore attributable to defects of the rails 2.

The delay Td represented in FIG. 4 can, as in FIG. 2, occur by a correlation of the signals $s_{12a}$, $s_{12b}$. This requires a correlation stage 14, to which the signal $s_{11b}$ of a sensor 11*b* is supplied upon being delayed by a variable delay element 16, and the signal $s_{11a}$ of the other sensor, 11*a*, is supplied without being delayed. A control signal is fed to the delay element 16 from the output 141 of the correlation stage 14, with the aid of which signal the time delay of the signal $s_{11b}$ can be modified until the undelayed signal s11*a* and the delayed signal $*s_{11b}$ delivered at the output 161 of the delay element 16 at least approximately overlap. The correlation of signals that occurs in the correlation stage 14 is known from radar technology, for example. A correlator which is supplied with an echo signal and with a transmission signal that is delayed in correspondence with the overall transit time of the echo signal is taught in *Radar Handbook,* M.I. Skolnik, McGraw Hill, New York 1970; p. 20–3, FIG. 1*c*. As long as the signals are identical and coincide in time, the correlator corresponds to a matched filter, wherein the supplied signals undergo convolution in accordance with the following convolution integral:

$$y(t) = \int_{-\infty}^{\infty} h(\tau)h(t-\tau)\,d\tau$$

The maximum value for y(t) is reached when the time interval Td between the two instants t1, t2 corresponds precisely to the set time delay. The correlation stage 14 thus controls the delay element 16 until the maximum value is achieved. It is also possible to utilize a plurality of correlators, to which the signals $s_{11a}$ and $s_{11b}$ are fed at a varying delay. By comparing the output signals of the correlators, it can be determined which time shift of the signals $s_{11a}$ and $*s_{11b}$ corresponds best to the time interval Td. The signals $s_{11a}$ and $*s_{11b}$, which are shifted relative to one another in correspondence with the time interval Td, are then fed to the difference stage 15, wherein the shifted signal curves $s_{11a}$ and $*s_{11b}$ are subtracted from each other. The resulting signal curve $s_{res}=S_{11a}-*s_{11b}$ is delivered to a signal processing unit 17 by way of output 151.

The signals which are delivered by the correlation stage 14 by way of output 142 can alternatively be evaluated by the signal processing unit 17, which feeds a control signal for setting the delay to the delay element 16 by way of the output.

Figure 4A:
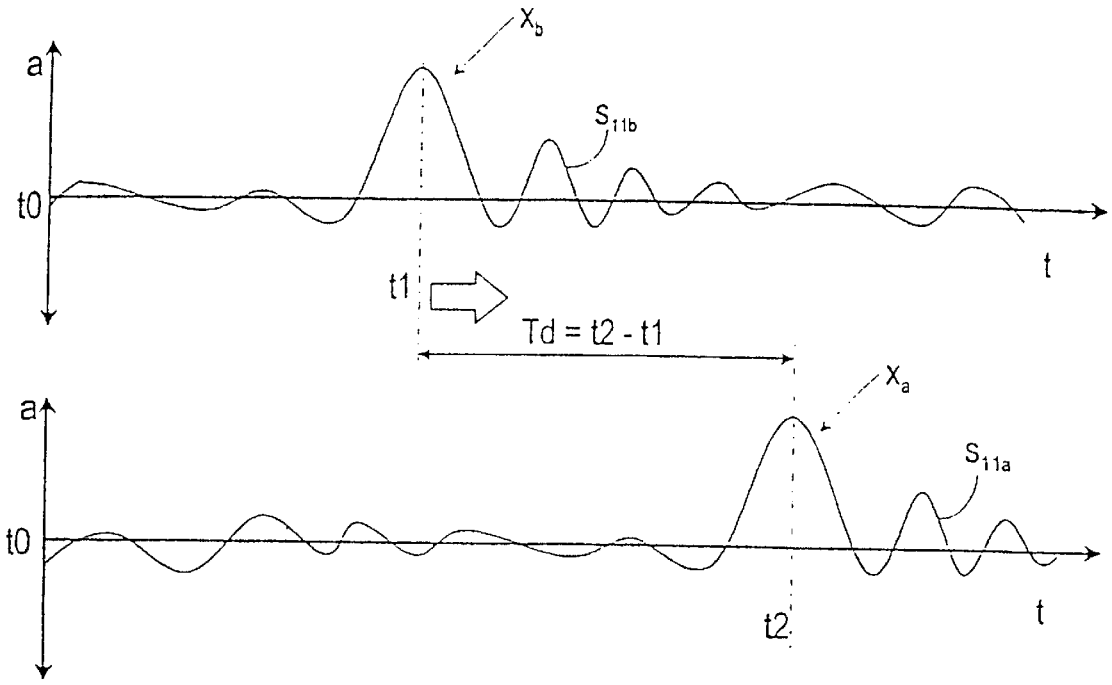
FIGS. 4A, 4B, and 4C are time graphs illustrating various accelerations which occur at the axles of the bogie.

FIG. 4A represents the curves of the signals $s_{11a}$ and $s_{11b}$ which are delivered by the sensors 11*a,* 11*b.* A disturbance (namely, sharp accelerations $x_a$ and $x_b$, respectively) which is caused by unevenness in the road or rails 2 (see FIG. 1, track defects 8), is registered in the axle 5*a* at time t1 and in the axle 5*b* at time t2. As described above, these track defects 8 should not be interpreted as defects of the bogie 1.

Figure 4B:
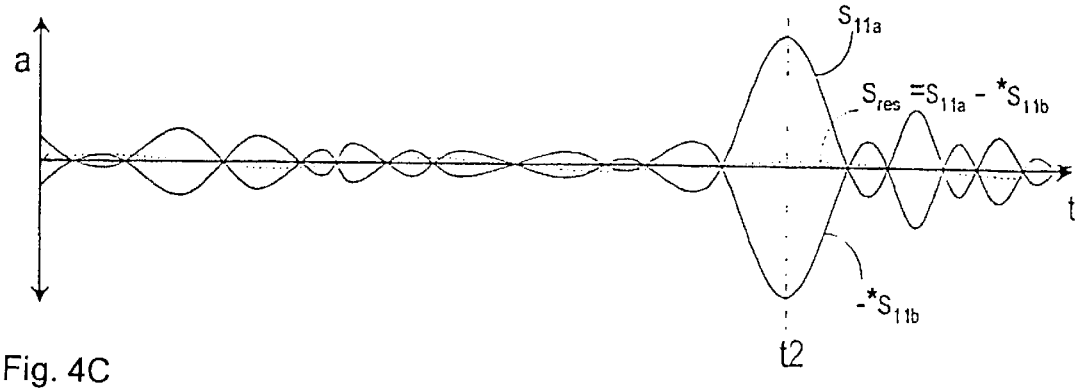

FIG. 4B represents the inverted curve of the signal $s_{11b}$ and the non-inverted curve of the signal $s_{11a}$. The two curves of the signals $s_{11a}$ and $s_{11b}$ are shifted by the value Td; therefore, their difference, which is formed in the difference stage 15, produces a signal curve $s_{res}$ which runs along the zero line given ideal behavior of the bogie 1.

This way, external influences which affect the suspension 1 can be distinguished from the accelerations caused by the bogie 1 with the aid of the shifting and difference formation of the curves of the signals $s_{11a}$ and $s_{11b}$ which are delivered by the sensors 11*a,* 11*b.* That is, the accelerations caused by track defects 8 have only a slight effect, if any, on the monitoring of the bogie 1. Expediently, the difference signal $s_{res}$ is compared in the signal processing stage 17 to a first threshold value, which is selected in such a way that crossing the threshold value indicates a disturbance, and falling short of the threshold value indicates that the bogie 1 is in perfect condition.

Figure 4C:
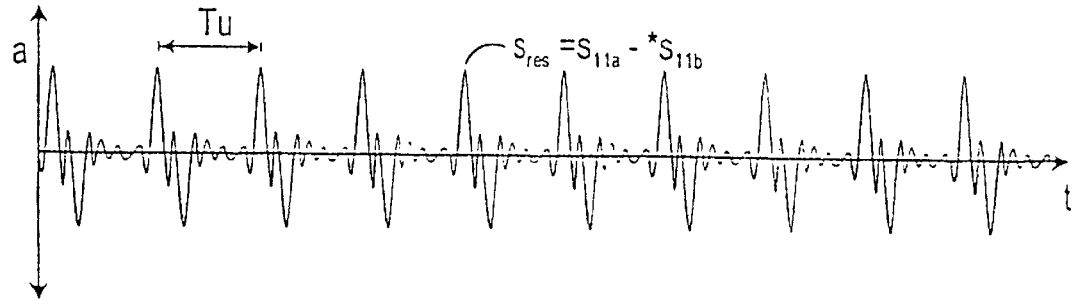

Accelerations which affect only one of the two wheel axles 5*a*, 5*b* are detected particularly clearly. FIG. 1 represents a flattening 9 of the wheel 4*b*, which was caused by locking of the brakes. FIG. 4C indicates the signal curve $s_{re}$, which results from the shifting and subtraction of the signal curves $s_{11a}$ and $s_{11b}$, onto which the accelerations caused by the flattening are impressed.

Low-frequency disturbances indicate a defect in the periphery of the wheel. On the other hand, a massive rise of the signals in the high-frequency range indicates damage at the axle bearing. By analyzing the signals, it can thus be determined which kind of damage has occurred. Fourier transformation can be used for the signal analysis, which makes it possible to represent and evaluate the signals in the frequency range.

The evaluation of the difference signal $s_{res}$ can be accomplished in different ways. Expediently, at least one second threshold value, and potentially a threshold value profile, is prescribed, which contains signal values for particular frequency ranges. When they are exceeded, an error signal is output.

It can also be seen from the signal curve $s_{res}$ represented in FIG. 4C that peak values which indicate damage to the running surface of a wheel 4*a*, 4*b* occur periodically at time intervals Tu. By measuring the period duration between two peak values, it is possible to compute the velocity v ($v=2\pi r/Tu$) of the vehicle given knowledge of the radius of the wheels 4*a*, 4*b* (here, r represents the radius of the running surface of the wheels, which is indicated in dashed lines). Since practically all wheels of bogies exhibit a specific periodic behavior, the invention thus makes it possible to reliably measure the running velocities v.

The two time differences Td and Tu are defined as follows: The time difference Td corresponds to the spacing d between the two wheel axles of a bogie and depends on the speed the train runs. Td becomes larger the slower the train runs and vice versa. On the other hand, the time difference Tu corresponds to the dimension of the train wheel with respect to its diameter at the height of the running surface. Tu also depends on the speed of the train as given below.

A known relationship exists thus between the two time differences Td and Tu which does not depend on the train speed as long as only their quality is regarded. Tu is equal to or larger than Td, if the distance d is equal to or smaller than the circumferential length of the running surface of the train wheel. With respect to the quantity of Td and Tu it has to be clearly pointed out that both are a reciprocal function of the train speed, as follows: $Td=d/v$ and $Tu=2\pi r/v$.

The time interval Td between the two instants t1, t2 at which the first and second wheels 4*a* and 4*b* of the bogie travel over a particular track position can also be computed with the aid of the velocity v and the spacing d of the axles 5*a*, 5*b*. The time interval Td equals d/v, or $Tu * d/2\pi r$. The velocity v may also be supplied by the vehicle computer.

The velocity v is expediently taken into consideration in the signal processing unit 17 in the monitoring of the difference signal $s_{res}$. For instance, a threshold value profile is provided, wherein threshold values are defined as a function of velocity.

If a sudden deviation of the adapted mechanical behavior of the bogie 1 is detected by the adaptation stage 13 and the signal processing unit 17, two causes may be responsible. To the extent that the difference signal sres does not exhibit a sudden variation, external influences are present, which can be evaluated by the signal processing unit 17 and forwarded, potentially upon being provided with location and time stamps, as warranted. On the other hand, to the extent that the difference signal Sre, does exhibit a sudden variation, there is a defect of the bogie 1.

Given the detection of damage at the road or tracks 2 or at CUD the bogie 1, the provided measures can be initiated without delay. Given damage to the road or tracks 2, a reduction of speed is called for; given damage to the bogie 1, the vehicle should be stopped. Different conditions can be detected by the signal processing unit 17 with the aid of the signal analysis, with corresponding measures being allocated to each. Given substantial deviations of the adapted signal profile from a standard profile, a revision request must be signaled without impeding the vehicle's journey. In this case, or when defects are detected in the rails 2, the provided maximum speed can be reduced. Given sudden changes of smaller scale which are recognized as defects to a bogie 1, the maximum speed can be reduced. Given sudden changes of larger scale, a vehicle stop and an inspection of the affected bogie 1 should be performed.

Expediently, all three monitoring methods (checking external influences, checking slow deviations, and checking fast deviations of the behavior of the bogie) are applied simultaneously. Of course, it is also possible to apply one or two of the methods only.

The construction of the monitoring circuit 10 is substantially arbitrary. The tasks of the monitoring circuit 10 can also be taken over by a single signal processor.

Figure 3:
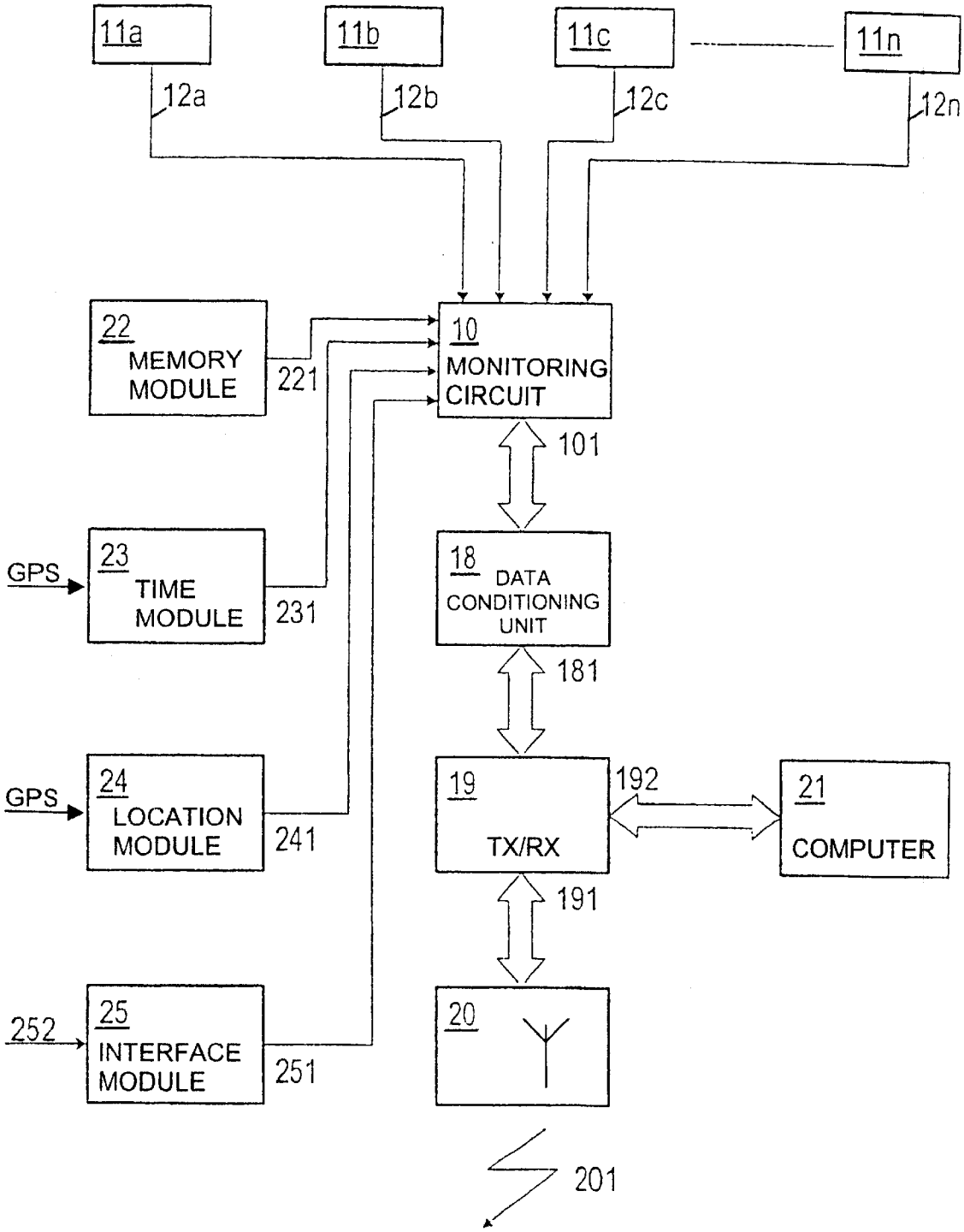
FIG. 3 is a block diagram of a monitoring circuit, to which data can be fed from several modules, and whose output signals are fed to a transmission device.

FIG. 3 represents the monitoring circuit 10 which can be supplied, by a plurality of modules 22, 23, 24, 25, with data which are expediently taken into consideration in the processing of the measuring signals or linked with the measurement results or the error and alarm messages.

All technical and logistical data of the vehicle, i.e. the train car, whose bogies 1 are being monitored are stored in a memory module 22. These data can be taken into consideration in the evaluation of the signals or transferred to a checkpoint along with the determined results. The net or gross weight of the car can be used as parameters for the evaluation of the measuring signals. Expediently, the bogie data as well as the standard profiles are retrievable from the memory module 22. To the extent that an individual vehicle number is stored in the memory module 22, this can be linked with the error and alarm messages.

Expediently, time and location information can also be retrieved from additional modules 23 and 24, which can also be linked with the error and alarm messages. Expediently, the modules 23 and 24 are coupled to a GPS (Global Positioning System) sender, which provides corresponding data for this purpose. The ambient temperature should also be considered as a parameter, which may be in the range between −20° C. and +40° C., depending on the location and season, which can lead to corresponding changes of the operating behavior of the bogie 1.

The module 25 serves as an interface to the vehicle computer, which transfers various operating information to the monitoring unit. Of course, the operating behavior of the bogie 1 is strongly influenced by potential braking operations. A rise of the signals in the upper frequency band conditional to a braking process must not be evaluated as an axle break. Thus, all actions are signaled to the monitoring device by the vehicle computer, so that the monitoring device either is temporarily deactivated or provided with a valid signal profile for this status. If the operating behavior of the bogie 1 should deviate from this signal profile during the braking process, it can be determined that the brakes or the appertaining control and mechanical systems are exhibiting an abnormal behavior and may be damaged. For instance, if a braking operation is signaled, but no subsequent change of the operating behavior occurs, it can be determined that the brakes have not been activated in the relevant bogie 1.

The data detected by the monitoring device are expediently transferable to the vehicle computer, a tachograph, and/or a display device in the vehicle. Of course, the detected data can also be transferable to a control center using beacons, radio systems, and so on (see e.g. Signal+Wire, Tetzlaff, Hamburg, January/February 1999: 30–33).

To this end, the monitoring circuit 10 represented in FIG. 3 is provided with a transmission and reception stage 19 by way of a data conditioning unit 18, which transfers the data and messages to a control station over an antenna system 20 and/or to the vehicle computer 21 over a bus system 192.

Expediently, all wheels 4 and axles 5 of a bogie 1 are monitored. The bogie 1 can be constructed in an arbitrary fashion, for instance as a car with only two axles.

The monitoring device can be used for multi-axle vehicles in street traffic as well as rail traffic.

We claim:

1. A method of monitoring a bogie of a multi-axle vehicle guided on a running surface, the method which comprises:

detecting respective accelerations of at least two axles of the bogie with acceleration sensors;

subjecting sensor signals received from the acceleration sensors to a Fourier transformation in FFT modules provided in an adaptation stage and generating frequency profiles with the FFT modules;

selecting one or more comparison operations from the following group:

comparing the frequency profiles, in a first check module, to one another, to originally measured frequency profiles, and/or to a correspondingly selected standard profile;

comparing the frequency profiles, in a second check module, to respective average value profiles formed in storage stages; and comparing the average value profiles formed in storage stages directly to each other, to originally measured frequency profiles, and/or to a correspondingly selected standard profile; and comparing determined deviations to threshold values, and accordingly delivering message signals to systems serving to control the vehicle.

2. The method according to claim 1, which comprises registering the deviations determined in at least one of the first check module and the second check modules as defects of the bogie or the running surface in dependence on a result of an evaluation of a signal curve $s_{res}=s_{11a}-{}^{*}s_{11b}$, where $s_{11a}$ is a sensor signal and ${}^{*}s_{11b}$ is a delayed sensor signal.

3. The method according to claim 1, which comprises modifying one of the threshold values and threshold value profiles, selected as a function of frequency, in dependence on one of a velocity and an acceleration of the vehicle.

4. The method according to claim 1, which comprises linking disturbances detected in dependence on the deviations to information selected from the group consisting of time and location information.

5. The method according to claim 1, which comprises determining, in a signal processing unit, a period duration of periodically occurring disturbances, and calculating a velocity of the vehicle as a function of a diameter of wheels of the vehicle.

6. A method of monitoring a bogie of a multi-axle vehicle running on wheels and guided on a running surface, the method which comprises:

detecting respective accelerations of at least two axles of the bogie with acceleration sensors;

shifting sensor signals received from the acceleration sensors relative to one another with a controllable timing element, to compensate for a time difference between instants at which the wheels of the bogie respectively pass a given point on the running surface;

subtracting shifted signal curves from one another in a difference stage to form a resulting signal curve $s_{res}=s_{11a}-{}^{*}s_{11b}$ representing a condition of the bogie; and comparing the resulting signal curve to at least one threshold value or threshold value profile in a signal processing unit

7. The method according to claim 6, which comprises calculating the time difference between the instants by correlating the sensor signals.

8. The method according to claim 6, which comprises calculating the time difference between the instants from a velocity of the vehicle and a spacing between the axles carrying the respective wheels.

9. The method according to claim 6, which comprises providing a first threshold value or threshold value profile, and determining therewith, by comparison with the resulting signal curve, whether vibrations are being caused by the running surface or by an anomaly of the bogie; and providing a second threshold value or threshold value profile, and determining therewith whether the bogie contains a defect that should be signaled.

10. The method according to claim 6, which comprises providing a threshold value or threshold value profile, and determining therewith, by comparison with the resulting signal curve, whether vibrations are being caused by the running surface or by an anomaly of the bogie.

11. The method according to claim 6, which comprises providing a threshold value or threshold value profile, and determining therewith whether the bogie contains a defect that should be signaled.

12. The method according to claim 6, which comprises registering deviations determined in at least one of a first check module and a second check module as defects of the bogie or the running surface in dependence on a result of an evaluation of a signal curve $s_{res}=s_{11a}-{}^{*}s_{11b}$, where $s_{11a}$ is a sensor signal and ${}^{*}s_{11b}$ is a delayed sensor signal.

13. The method according to claim 6, which comprises providing a first threshold value or threshold value profile and modifying one of the threshold values and the threshold value profiles, selected as a function of frequency, in dependence on one of a velocity and an acceleration of the vehicle.

14. The method according to claim 6, which comprises linking disturbances detected in dependence on deviations to information selected from the group consisting of the time and location information.

15. The method according to claim 6, which comprises determining, in the signal processing unit, a period duration of periodically occurring disturbances, and calculating a velocity of the vehicle as a function of a diameter of the wheels.

16. A device for monitoring a bogie of a multi-axle vehicle guided on a running surface, comprising:

a plurality of acceleration sensors respectively disposed for sensing vibrations of at least two axles of the bogie and configured to convert vibrations of the axles into sensor signals;

a signal processing unit connected to said sensors for receiving the sensor signals for further evaluation;

an adaptation stage having at least one FFT module connected to receive the sensor signals from said acceleration sensors and for outputting frequency profiles;

at least one comparison unit selected from the group of units consisting of:

a first check module configured for one of comparing the frequency profiles to one another, comparing the frequency profiles to originally measured frequency profiles, and comparing the frequency profiles to a correspondingly selected standard profile;

storage stages, and a second check module configured to compare the frequency profiles to respective average value profiles formed in said storage stages; and a comparator for comparing the average value profiles formed in the storage stages directly to each other, to originally measured frequency profiles, or to a correspondingly selected standard profile; and a device for comparing determined deviations with threshold values, and for delivering messages accordingly to systems serving to control the vehicle.

17. A device for monitoring a bogie of a multi-axle vehicle guided on a running surface, comprising:

a plurality of acceleration sensors respectively disposed for sensing vibrations of at least two axles of the bogie and configured to convert vibrations of the axles into sensor signals;

a controllable timing element connected to receive the sensor signals for shifting the sensor signals relative to one another to compensate for a time difference between instants at which wheels of the bogie respectively pass a given point on the running surface;

a difference stage for subtracting the shifted signal curves from one another to form a resulting signal curve $s_{res}=s_{11a}-{}^{*}s_{11b}$ representing a condition of the bogie; and a signal processing unit for comparing the resulting signal curve $s_{res}=s_{11a}-{}^{*}s_{11b}$ to at least one threshold value or threshold value profile.

18. The device according to claim 17, which comprises a correlation stage configured to calculate the time difference between the instants by correlating the sensor signals.

19. The device according to claim 17, wherein said signal processing unit is configured to calculate the time difference between the instants from a velocity of the vehicle and a spacing between the axles carrying the respective wheels.

20. The device according to claim 17, wherein said signal processing unit is configured to classify deviations determined in one of a first check module and second check modules as defects of the bogie or the running surface in dependence on the results of the evaluation of the signal curve $s_{res}=s_{11a}-{}^{*}s_{11b}$.

* * * * *